United States Patent [19]

Müller

[11] Patent Number: 5,039,843

[45] Date of Patent: Aug. 13, 1991

[54] SAFETY CUTOUT DEVICE

[75] Inventor: Manfred K. Müller, Pforzheim, Fed. Rep. of Germany

[73] Assignee: Limitor AG, Zurich, Switzerland

[21] Appl. No.: 113,183

[22] PCT Filed: Jan. 14, 1987

[86] PCT No.: PCT/EP87/00013

§ 371 Date: Sep. 11, 1987

§ 102(e) Date: Sep. 11, 1987

[87] PCT Pub. No.: WO87/04560

PCT Pub. Date: Jul. 30, 1987

[30] Foreign Application Priority Data

Jan. 16, 1986 [DE] Fed. Rep. of Germany ..... 3601055

[51] Int. Cl.[5] ..... H05B 1/02; H01H 61/02; H01H 77/04; D06F 75/26

[52] U.S. Cl. ..... 219/511; 38/82; 200/61.45 R; 219/251; 337/3; 337/104

[58] Field of Search ..... 219/245, 250–255, 219/257, 511; 38/74, 82; 200/61.45; 337/104, 2, 3, 12, 13

[56] References Cited

U.S. PATENT DOCUMENTS

| | | | |
|---|---|---|---|
| 1,461,878 | 7/1923 | Harvey | 219/251 |
| 2,367,985 | 1/1945 | Weeks . | |
| 4,661,685 | 4/1987 | Comtri | 219/250 |
| 4,686,352 | 8/1987 | Nawrot et al. | 219/257 |

FOREIGN PATENT DOCUMENTS

| | | | |
|---|---|---|---|
| 102574 | 3/1984 | European Pat. Off. . | |
| 2261974 | 6/1974 | Fed. Rep. of Germany . | |
| 2824210 | 12/1979 | Fed. Rep. of Germany . | |
| 3111099 | 9/1982 | Fed. Rep. of Germany . | |
| 8510110 | 8/1985 | Fed. Rep. of Germany . | |
| 3506784 | 9/1985 | Fed. Rep. of Germany . | |
| 899106 | 7/1944 | France . | |
| 1379560 | 10/1964 | France | 200/61.45 |
| 88835 | 2/1967 | France | 219/250 |
| 60-14784 | 1/1985 | Japan . | |
| 593370 | 10/1947 | United Kingdom | 337/104 |

*Primary Examiner*—Anthony Bartis

*Attorney, Agent, or Firm*—Balogh, Osann, Kramer, Dvorak, Genova & Traub

[57] ABSTRACT

A safety cutout device for electric loads, particularly for use in pressing irons and portable heating apparatus, has a temperature switch, such as a bimetallic switch, which is adapted to be connected in series with the electric load. An electrical component adapted to be connected in parallel with the load and having an open and a closed switching state, and being normally open, is connected in series with a resistor adapted to be connected in parallel with the load and arranged in heat transfer relationship with the temperature switch and for heating the temperature switch to its operating temperature to open the switch. A further resistor, which continuously bridges and heats the temperature switch to an extent sufficient to maintain the temperature switch in its actuated open position, is connected in parallel with the temperature switch and adapted to be connected in series with the load. The electrical component may be a position or acceleration responsive switch, level sensor, photocell, photodiode, mercury switch, etc. The temperature switch, resistors and electrical component are mounted on a ceramic plate.

20 Claims, 4 Drawing Sheets

SAFETY CUTOUT DEVICE

TECHNICAL FIELD

The invention is based on a safety cutout device for electric loads, particularly for use in pressing irons and portable heating apparatus.

STATE OF THE ART

Such a device is known from German Offenlegungsschrift 3,506,784. It contains two components which are, on the one hand, a temperature switch which is located in series with the load, opens when overheated and, as a result, switches off the load and, on the other hand, a switch which operates in dependence on position and which is located in parallel with the load, is opened in the normal position of the equipment and has a series resistor which heats the temperature switch when the switch operating in dependence on position closes. Due to the heating, the temperature switch exceeds its switching temperature after some time and opens so that the load is also switched off due to the operating of the position-dependent switch. If it is assumed that the temperature switch is not located in the circuit of the switch operating in dependence on position, the temperature switch, after operating, remains open due to its continuing heating until the equipment is returned to its normal position in which the position-dependent switch opens, as a result of which its series resistor loses its current and gradually cools down. However, during overheating of the temperature switch which does not originate from this series resistor, no provision is made for the temperature switch to remain open after operating, instead it will automatically switch on again after having cooled down, regardless of whether the disturbance which led to the overheating has been eliminated or not.

DISCLOSURE OF THE INVENTION

The invention is based on the object of developing a safety cutout device of the type initially mentioned in such a manner that the temperature switch which switches off the load is automatically kept open after operation, for whatever reason.

The resistance value of the additional resistor is selected, in adaptation to the respective switching and sensing task of the temperature switch and to the resistance value of the load, in such a manner that, when the temperature switch is closed, the predominating proportion of the current flowing through the load takes a direct path via the temperature switch and only a comparatively small proportion of the current flows via the additional resistor so that the resistive heat generated in the resistor is not sufficient for heating the temperature switch to its switching temperature. If, however, the temperature switch operates due to overheating, current only flows through the additional resistor and, possibly, through the series resistor of the switch, which preferably operates in dependence on position and/or in dependence on acceleration, if it is closed. For this reason, the resistance value of the further resistor bridging the temperature switch must be selected, on the other hand, in such a manner that, with the temperature switch open, the resistive heat generated due to the higher current passing through the additional resistor is sufficient for keeping the temperature switch open. The heating power needed for this is typically of the order of magnitude of a few watts. With a feed voltage of 220 volts, suitable resistance values for the additional resistor are of the order of magnitude of 10kΩ, for example between 5kΩ and 25kΩ. The series resistor belonging to the switch operating due to position changes or accelerations must be capable of heating up the temperature switch within a suitable time from its normal operating temperature up to above its switching temperature, which requires a somewhat greater heating power than if it is merely kept open. It is therefore recommended to select the resistance value of this series resistor to be slightly lower than the resistance value of the additional resistor which continuously bridges and heats the temperature switch.

In a particularly advantageous arrangement of the two resistors, these bridge the temperature switch whilst being connected in series and, at the same time, are in a parallel arrangement series resistors of the switch preferably operating in dependence on position and/or acceleration. With undisturbed conditions (the temperature switch is closed and the switch operating due to position changes and/or accelerations is open), only a negligible current, which is insufficient for opening the temperature switch, flows through the two series-connected resistors. If, however, the switch operating due to position changes and/or accelerations is closed, a current flows through it which branches via the two resistors so that resistive heat is generated in both resistors which heats and finally opens the temperature switch. After the opening of the temperature switch, the current path is then interrupted through one of the two resistors so that only the resistive heat generated in one of the resistors is used in the required manner for keeping the temperature switch open. Thus, this type of arrangement of the resistors allows the temperature switch to be kept open with a lower heating power and the temperature switch to operate rapidly due to the higher heating power of the resistors after closing of the switch operating due to position changes and/or accelerations. When overheating occurs without the switch operating due to position changes and/or accelerations operating, the operating speed of the temperature switch depends in any case on the type of disturbance, and in this case the same resistor is again responsible for keeping the temperature switch open as during the closing of the switch operating due to position changes and/or accelerations. This resistor is therefore suitably selected in such a manner that it produces a heating power which is as low as possible but is sufficient for keeping the temperature switch open under all circumstances. After that, the other resistor can be selected in such a manner, or in the case of a potentiometer adjusted in such a manner, that the required operating speed of the temperature switch as a result of closing of the switch operating due to position change and/or accelerations is obtained.

To achieve a favorable heat transfer from the resistors to the temperature switch, they are suitably arranged next to the temperature switch. It is particularly advantageous to supplement a bimetallic switch by means of thickfilm resistors in such a manner that the contact spring and the two switching contacts of the bimetallic switch are located on one side of an electrically insulating base and the resistors on the other side of the base, in which arrangement either the resistors and the bimetallic element are located on the same side of the base or an opening is provided in the base through which opening as unimpeded as possible a heat transfer from the resistors on the one side of the base to the bimetallic element on the other side of the base is possible.

Another advantageous possibility consists in selecting as a base of the temperature switch a ceramic plate (wafer) which carries on one side the contact spring and the switching contacts and on the opposite side the resistance layers.

Using thickfilm resistors has the further advantage that the switch, which preferably operates in dependence on position and/or acceleration, can be directly attached to the base or bases of the thickfilm resistors, as a result of which an easily handled compact constructional unit is obtained. The switch operating in dependence on position and/or acceleration is best accommodated in a block-shaped, preferably cub-shaped, case which has at several, preferably at three sides which are perpendicular to one another, means for mounting, so that one and the same switch can be mounted with different orientation depending on the respective case of application.

For the rest, suitable switches operating in dependence on position and/or acceleration are those which have in one case two mutually insulated electrodes and an electrically conductive sphere, which can be freely moved between them and which makes contact with the two electrodes only in the predetermined position or when there is a lack of acceleration. Switches with a suitable electrode shape are described for example in German Offenlegungsschrift 3,111,099, in German Offenlegungsschrift 2,261,974, in German Offenlegungsschrift 2,824,210 and in German Utility Model 8,510,110.

Another possibility for constructing a switch operating in dependence on position consists in providing in one case two mutually insulated electrodes one of which is constructed in the form of a bell and the other one of which is arranged inside it in the manner of a freely swinging clapper, in which arrangement this switch closes when the clapper contacts the bell-shaped electrode.

In an advantageous further development of the invention, the switch operating in dependence on position and/or acceleration can be replaced by a different electric or electronic switchable component which is conductive in one switching state and blocks in another switching state, for example a photodiode, a transistor, an arbitrarily actuable microswitch, a level sensor or suchlike. A photodiode as a switch can be driven by a light source, a transistor can be driven by a sensor having an electric output signal, a microswitch can be operated by hand or by a machine part, a level sensor can become conductive when immersed into an electrolyte and so forth. Thus, the most varied parameters can be sensed and, when a limit value is exceeded, the associated load can be switched off by means of a temperature switch which additionally also offers overheating protection.

Illustrative embodiments of the invention are shown in the attached diagrammatic drawings.

DETAILED DESCRIPTION OF THE DRAWINGS, INCLUDING APPROACHES FOR CARRYING OUT THE INVENTION

Figure 1:
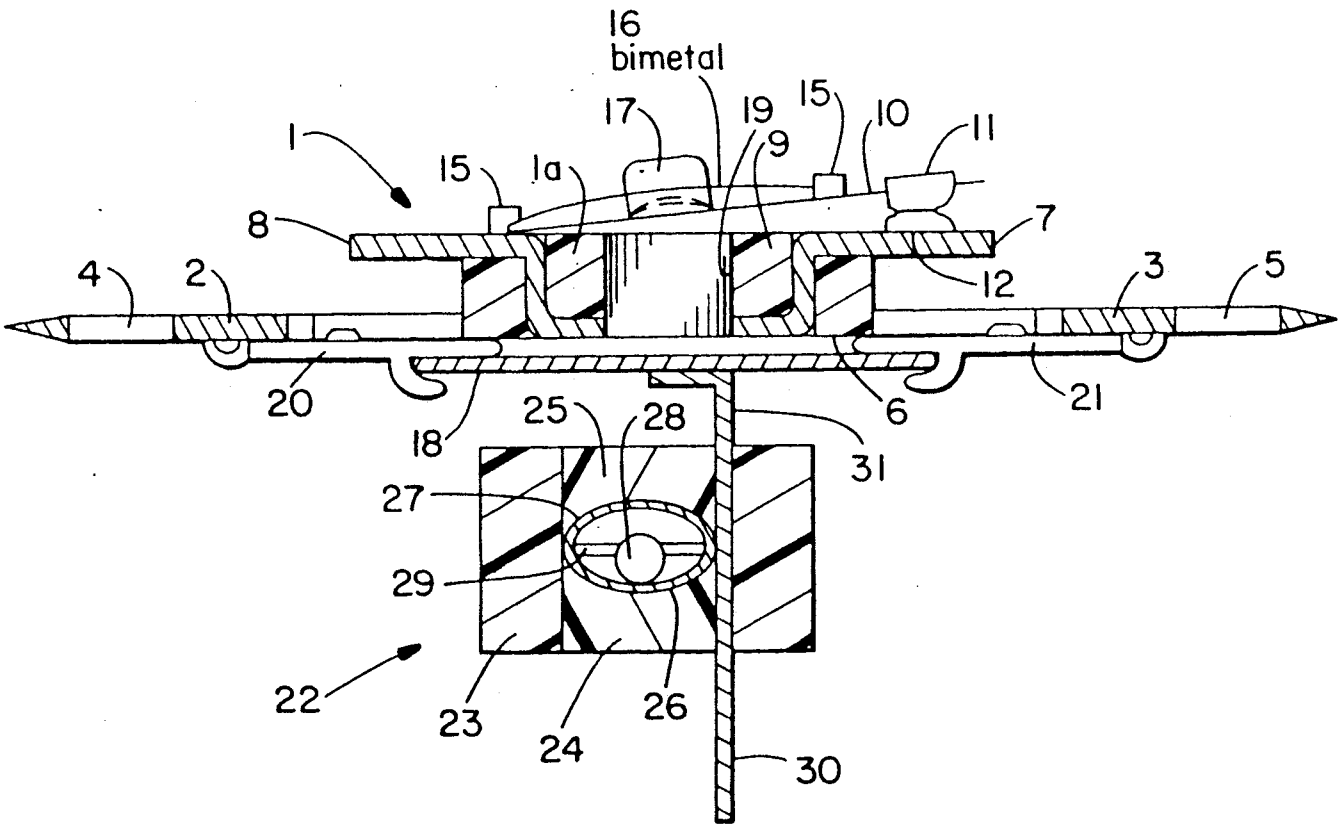
FIG. 1 shows a longitudinal section through a bimetallic switch combined with a switch operating in dependence on position and/or acceleration.

FIG. 1 shows a bimetallic switch 1 in which two electric connecting tabs 2 and 3 having solder lugs 4 and 5 are embedded in an electrically insulating flat base 1*a*.

From the connecting tabs 2 and 3, tongues 7 and 8 are stamped out, raised in the form of steps and also embedded in sections into the base 1*a*. The tongues 7 and 8 are at the level of and parallel to the upper side 9 of the base 1*a*, the connecting tabs 2 and 3 are at the level of and parallel to the underside 6 of the base 1*a*.

On one tongue 8, a contact spring 10 is attached by one end and carries at its moving end a switching contact 11 which operates in conjunction with a stationary switching contact 12 which is attached to the other tongue 7. A bimetallic snap disk 16 is held loosely between hooks 15 at the front and rear of the contact spring 10 and legs 17 on the side of the contact spring. As an alternative, the bimetallic snap disk could also be arranged on the underside of the contact spring 10, that is to say between the contact spring 10 and the base 1*a*.

On the underside of the base 1*a*, a ceramic plate 18 is arranged which is used as a base for one or two thickfilm resistors. To the ceramic plate 18, two rigid connecting tabs 20, 21 are attached which project in opposite directions from the plate 18 and are soldered to the connecting tabs 2 and 3, respectively, of the bimetallic switch.

The base 1*a* has an opening 19 which goes through from the bottom to the top and through which the resistive heat generated in the thickfilm resistor or resistors can pass to the bimetallic snap disk 16.

In addition, a switch 22, which operates due to position changes and/or accelerations, is provided which has a case 23 with a cylindrical through-hole. Into the hole two inset parts 24 and 25 are inserted the surfaces of which, facing one another, are slightly concave in construction and are covered with two electrodes 26 and 27, respectively, which delimit a hollow space in which an electrically conductive sphere 28 is arranged in a freely moveable manner.

The case 23 and the two inset parts 24 and 25 consist of plastic. Between the two inset parts 24 and 25 there is a plastic ring 29 which keeps the two inset parts, and thus also the two electrodes 26 and 27, at a distance. From the two electrodes which, for example, can be formed by currentless metal deposition on the two inset parts 24 and 25, connecting tabs 30 and 31 each lead outwards in opposite directions through the gap between two inset parts 24 and 25, on the one hand, and the the case 23 on the other hand. The switch 22 is soldered with one of these connecting tabs 31 to a current path on the ceramic plate 18.

Figure 7:
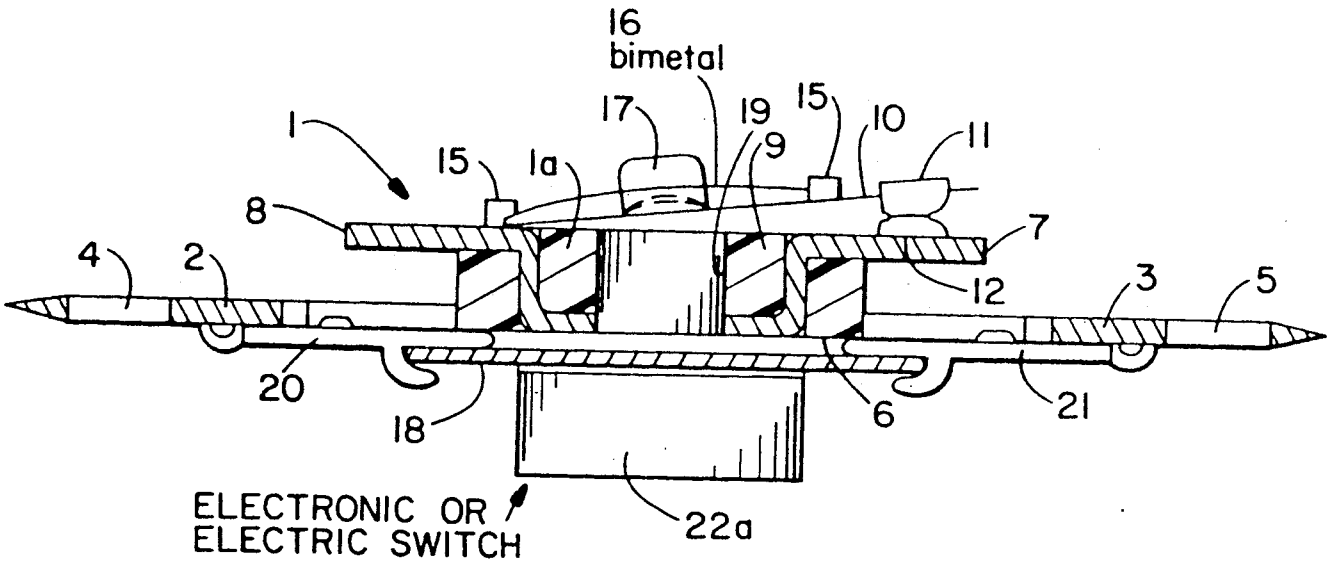
FIG. 7 shows a modified embodiment similar to that illustrated in FIG. 1.

The sphere 28 consists of metal at least on its surface. In the position shown, the switch 22 is open. In the case of high accelerations in a plane extending perpendicularly to the plane of the drawing or when the switch 22 is tilted by 90°, the sphere 28 moves into a position in which it makes contact with the two electrodes 26 and 27 by bridging the narrow ring 29, and, as a result, closes the switch. The switch 22 can be replaced by a transistor, an arbitrarily actuable microswitch, a mercury switch or by a sensor 22*a* as shown in FIG. 7 to accommodate other applications.

Figure 5:
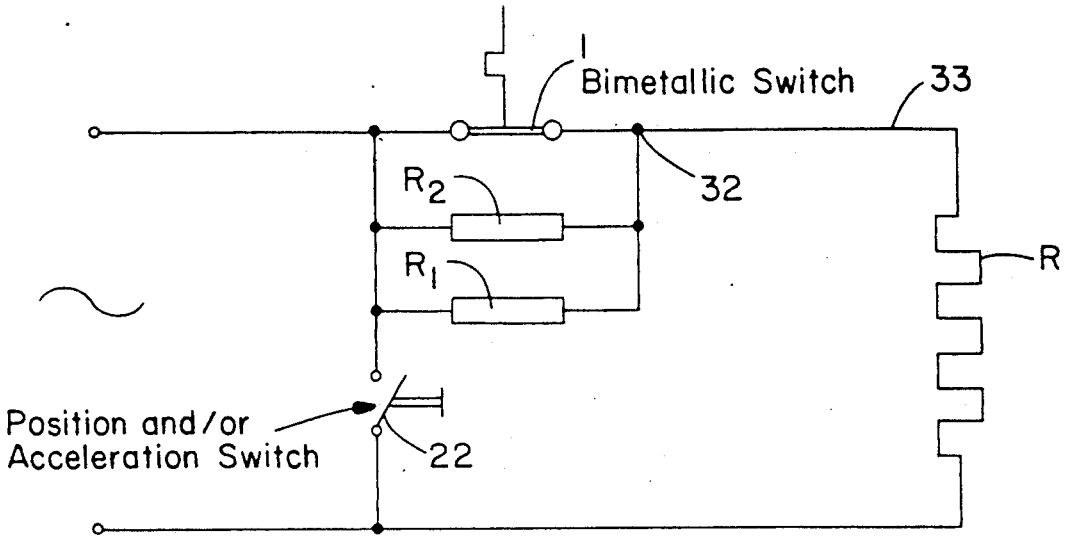
Figure 6:
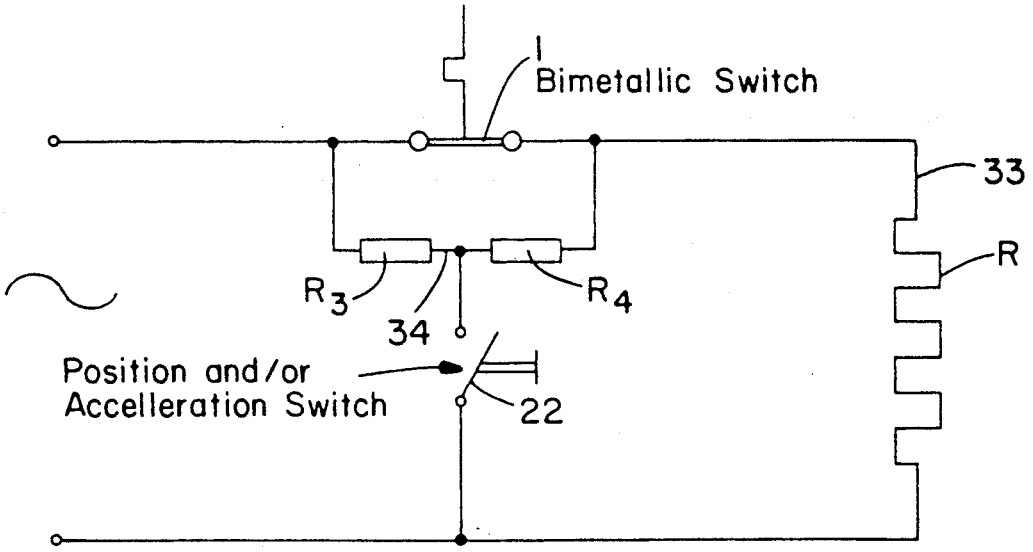
FIG. 6 shows a second illustrative embodiment of a safety cutout device according to the invention.

Circuit examples of the device shown in FIG. 1 are shown in FIG. 5 and FIG. 6.

FIG. 5 shows a load R which is fed from an alternating-voltage source and which is in series with the bimetallic switch 1. In parallel with the bimetallic switch, a resistor $R_2$ is provided which continuously bridges the bimetallic switch 1. An electric or electronic switchable component 22 which is conductive in one switching state and blocks in another switching state. The component 22 may be for example, a photodiode, a transistor, an arbitrarily actuable microswitch, a level sensor or suchlike in particular can be used. In a switch operating in dependence on position and/or acceleration, is connected in parallel with the load R and, at the same time, in series with a series resistor $R_1$ . One end of resistor $R_1$ is connected to the switch 22 and the other end of resistor $R_1$ is connected to a connecting point 32, located between the bimetallic switch 1 and the load R, of the line 33 carrying the main current. Resistors $R_1$ and $R_2$ are preferably thickfilm resistors which are located on the ceramic plate 18.

With a line voltage of 220 V and a load resistance of $R=50\Omega$, resistors $R_1$ and $R_2$ have the following suitable values:

$R_1=10k\Omega$ $R_2=30k\Omega$

In the normal operating condition, that is to say with a closed bimetallic switch 1 and open switch 22, no current at all flows through resistor $R_1$ and only a negligible current through resistor $R_2$. If, however, switch 22 operates (for example due to a position change) and closes, the full line voltage is present across the ends of resistor $R_1$ so that resistor $R_1$ heats the bimetallic switch 1 with a heating power of approximately 4.8 W until this switch exceeds its switching temperature and opens. After that, the load R is without current and the line voltage has now dropped across the seriesconnected resistors $R_1$ and $R_2$ which now jointly only generate a heating power of approximately 1.2 W which, however, is sufficient for keeping the bimetallic switch 1 open.

In the circuit example according to FIG. 6, the load R is also fed from the alternating voltage line and the bimetallic switch 1, which is bridged by the two series-connected resistors $R_3$ and $R_4$ is located in series with the load R. The component 22, which exhibits two switching states and which is again, in particular, a switch which operates in dependence on position and/or acceleration is located in parallel with the load R in such a manner that the one terminal of the switch 22 is connected to the connecting line 34 of the two resistors $R_3$ and $R_4$. Using a line voltage of 220 V and a load resistance of $R=50\Omega$ as a basis, suitable resistance values for the two resistors $R_3$ and $R_4$ are $R_3=50k\Omega$ $R_4=15k\Omega$ In the normal operating condition when the bimetallic switch 1 is closed and the other switch 22 is open, only a negligible current flows through the resistors $R_3$ and $R_4$. If switch 22 closes, for example due to a position change, the full magnitude of the line voltage is dropped across each of the two resistors $R_3$ and $R_4$ which, in this case, are series resistors of the switch 22 which are connected in parallel with one another. In these resistors, resistive heat is generated with a power of, together, approximately 6.5 W by means of which the bimetallic switch 1 is heated until it exceeds its switching temperature and opens. After that, the full line voltage is only dropped across resistor $R_3$ and the bimetallic switch 1 is heated virtually only by resistor $R_3$ with the reduced power of approximately 3.25 W which is sufficient for keeping the bimetallic switch 1 open. The resistor $R_4$ and the load R are virtually without current.

Figure 2:
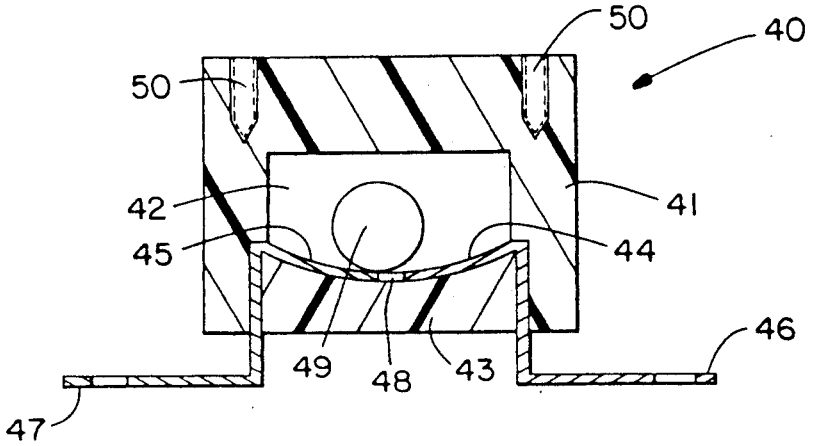
FIG. 2 shows a longitudinal section through another embodiment of a switch operating in dependence on position and/or acceleration, FIG. 3 the insert, carrying the electrodes, of the switch according to FIG. 2 in a top view.
Figure 3:
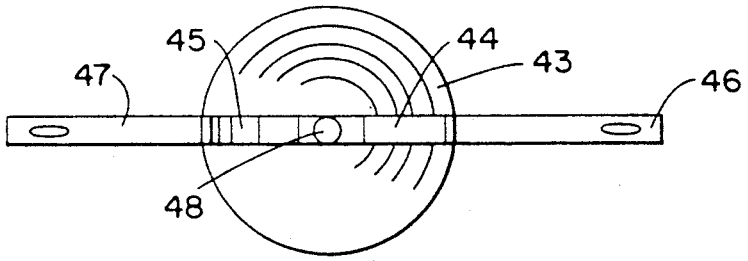
Figure 4:
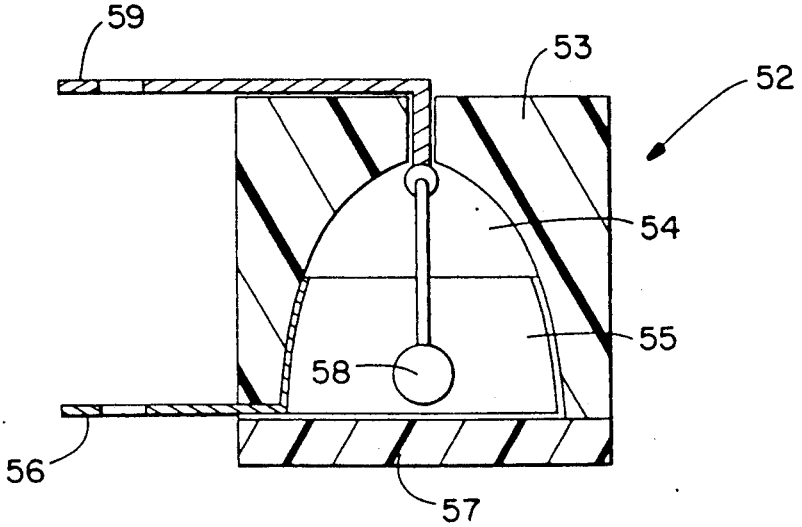
FIG. 4 shows another embodiment of a switch operating in dependence on position and/or acceleration, in a section, FIG. 5 circuit example of a safety cutout device according to the invention.

If it is not switch 22 but only the bimetallic switch 21 which operates due to overheating, the total current flows through the resistor $R_2$ in the circuit example according to FIG. 5 and through the two series-connected resistors $R_3$ and $R_4$ in the circuit example according to FIG. 6; in the first circuit example, resistor $R_2$ heats the bimetallic switch 1 with a power of approximately 1.6 W and keeps it open, in the second circuit example resistors $R_3$ and $R_4$ heat the bimetallic switch 1 with a power of, together, approximately 1.6 W and keep it open. At the same time, because of the high-resistance series resistor $R_2$ or $R_3+R_4$, the load R develops only a negligible power. In the arrangement according to FIG. 1, switch 22 can be replaced by a modified switch as shown in FIG. 2 or FIG. 4. The switch 40 shown in FIG. 2 and 3 is particularly suitable for use in pressing irons. Switch 40 has a case 41 with a cylindrical recess 42 which is closed by an inset part 43.

The inset part 43 has a slightly concave inside surface which is covered with two electrodes 44 and 45 the shape of which can be seen in a top view in FIG. 3. The case 41 and the inset part 43 consist of plastic. The electrodes 44 and 45 can be formed on the inset part 43 by currentless metal deposition.

The two electrodes 44 and 45 have the shape of a strip and both electrodes originate from the lowest point of the concave surface of the inset part 43 and extend in opposite directions up to the edge of the concave surface of the inset part 43. From there, two connecting tabs 46 and 47 lead outwards through, the gap between the case 41 and the inset part 43. In the center of the inset part 43 where the two electrodes 44 and 45 meet, a circularly edged indentation 48 which, at the same time, delimits the two electrodes 44 and 45 is provided in the concave surface.

In the hollow space 42, a freely moveable sphere 49 is located the radius of which is larger than the radius of the indentation 48 and which consists of metal, at least on its surface.

In the position shown in FIG. 2, the sphere 49 is located at the lowest point of the inset part 43 and makes contact with the two electrodes 44 and 45: the switch is closed. During position changes or during accelerations in a plane perpendicular to the plane of the drawing, the sphere 49 is deflected from its position shown in FIG. 2: the switch is opened.

The switch shown in FIG. 2 is built into the pressing iron in such a manner that it assumes the position shown in FIG. 2 when the pressing iron is standing on its pressing base. When the pressing iron is stationary, the sphere assumes the position shown in FIG. 2 and closes the switch so that, if one of the circuit examples shown in FIG. 5 and FIG. 6 is used, the pressing iron is switched off so that the material to be pressed or the ironing support are not accidentally singed. During the pressing, however, the pressing iron is moved to and fro which results in the sphere rolling to and fro on the concave surface of the inset part 43 and, at the most, connecting the two electrodes 44 and 45 with one another randomly and for brief periods. The short-duration current flow through resistor $R_1$ (circuit example FIG. 5) and resistors $R_3$ and $R_4$ (circuit example FIG. 6) occurring during this action does not, however, last long enough for heating the bimetallic switch 1 up to above its switching temperature, so that heating of the iron base is ensured during normal ironing movements. The same applies if the pressing iron is placed upright as is normal during pauses in the ironing.

FIG. 2 also shows two threaded holes 50 in the case which are used for mounting the switch 40.

The switch 52 shown in FIG. 4 has a case 53 having a bell-shaped hollow space 54 which carries in its lower region an annular electrode 55 from which a solder tab 56 leads outwards through the gap between the case 53 and a plate 57 closing the hollow space 54. A metallic clapper 58 is suspended in freely swinging manner in the hollow space 54. From the clapper 58, another solder tab 59 leads out of the case. In the normal position shown in FIG. 4, the clapper does not touch the electrode 55: the switch is open. If the switch 52 is tilted by 90° or 180° over one of its edges, the clapper 58 makes contact with the electrode 55 : the switch is closed.

What is claimed is:

1. Safety cutout device in combination with electric loads, particularly for use in pressing irons and portable heating apparatus, comprising:

a temperature switch which is adapted to be electrically connected in series with an electric load, for controlling the supply of electrical energy thereto;

an electric component, adapted to be electrically connected in parallel with the load and exhibiting an open switching state and a closed switching state and being normally in said open switching state;

means defining a resistor electrically connected in series with the electrical component, adapted to be electrically connected in parallel with the load and in heat transfer relationship with the temperature switch and capable of heating the temperature switch to its operating temperature to cause the switch to open and deenergize the load; and means defining an additional resistor in heat exchange relation with said temperature switch and which continuously bridges and heats the temperature switch an extent sufficient to maintain the temperature switch in its actuated open position and is connected in parallel with the temperature switch and adapted to be connected in series with the load.

2. Safety cutout device as claimed in claim 1, wherein the means defining said additional resistor comprises two resistance elements connected in series and arranged in bridging relationship with the temperature switch, and the electric component is connected to a line connecting the two resistance elements in series whereby the two resistance elements constitute the means defining said resistor in series with the electric component.

3. Safety cutout device as claimed in claim 2, wherein the resistance elements are thickfilm resistors.

4. Safety cutout device as claimed in claim 2, wherein the component exhibiting said open and closed switching states is a switch which operates in dependence on at least one condition selected from the group consisting of position and acceleration and which consists of a case having two mutually electrically insulated electrodes and an electrically conductive sphere which can be freely moved between them and which makes contact with the two electrodes only in a predetermined position or where there is a lack of acceleration.

5. Safety cutout device as claimed in claim 1, wherein the resistors are thickfilm resistors.

6. Safety cutout device as claimed in claim 5, wherein said temperature switch comprises a bimetallic switch having a contact spring and two switching contacts on one side of an electrically insulating base and the resistors on the other side of this base, and the base exhibits an opening through which a heat transfer from the resistors located on the one side to the bimetallic element located on the other side is possible.

7. Safety cutout device as claimed in claim 6, wherein the component exhibiting said open and closed switching states is a switch which operates in dependence on at least one group consisting of position and acceleration and which consists of a case having two mutually electrically insulated electrodes and an electrically conductive sphere which can be freely moved between them and which makes contact with the two electrodes only in a predetermined position or where there is a lack of acceleration.

8. Safety cutout device as claimed in claim 5, wherein the temperature switch includes a base comprising a ceramic plate having a topside supporting said switch and an underside which carries resistors.

9. Safety cutout device as claimed in claim 8, wherein the component exhibiting said open and closed switching states is a switch which operates in dependence on at least one group consisting of position and acceleration and which consists of a case having two mutually electrically insulated electrodes and an electrically conductive sphere which can be freely moved between them and which makes contact with the two electrodes only in a predetermined position or where there is a lack of acceleration.

10. Safety cutout device as claimed in claim 5, wherein the thickfilm resistors comprise at least one base on which said resistors are supported and to which the component exhibiting said open and closed switching states is directly attached.

11. Safety cutout device as claimed in claim 5, wherein the component exhibiting said open and closed switching states is a switch which operates in dependence on at least one group consisting of position and acceleration and which consists of a case having two mutually electrically insulated electrodes and an electrically conductive sphere which can be freely moved between them and which makes contact with the two electrodes only in a predetermined position or where there is a lack of acceleration.

12. Safety cutout device as claimed in claim 1, wherein the component exhibiting said open and closed switching states is a switch which operates in dependence on at least one condition selected from the group consisting of position and acceleration and which consists of a case having two mutually electrically insulating electrodes and an electrically conductive sphere which can be freely moved between them and which makes contact with the two electrodes only in a predetermined position or where there is a lack of acceleration.

13. Safety cutout device as claimed in claim 12, wherein the two electrodes are formed by two strips on a slightly concave surface of a switch part, which strips are separated from one another by a circularly limited indentation in the surface at the lowest point of this surface.

14. Safety cutout device as claimed in claim 12, wherein the case of the switch operating in dependence on position is block-shaped and has means for mounting at several mutually perpendicular sides.

15. Safety cutout device as claimed in claim 1, wherein the component exhibiting said open and closed switching states is a switch which operates in dependence on position and which consists of a case having two mutually insulated electrodes one of which is constructed in the form of a bell and the other one of which is arranged inside it in the manner of a swinging clapper adapted to contact said bell electrode upon change in position.

16. Safety cutout device as claimed in claim 1, wherein the component exhibiting said open and closed switching states is a component which is conductive in its closed switching state and blocks in its open switching state.

17. Safety cutout device as claimed in claim 16, in which the component exhibiting said open and closed switching states is selected from the group comprising a transistor, an arbitrarily actuable microswitch, a mercury switch and sensors like a photocell, a photodiode, and a level sensor.

18. Safety cutout device as claimed in claim 1, wherein the component exhibiting said open and closed switching states is a switch which operates in dependence on at least one group consisting of position and acceleration and which consists of a case having two mutually electrically insulated electrodes and an electrically conductive sphere which can be freely moved between them and which makes contact with the two electrodes only in a predetermined position or where there is a lack of acceleration.

19. Safety cutout device according to claim 1, in which the temperature switch is a bimetal switch.

20. Safety cutout device according to claim 1, in which the said electric component is a switch operating in selective dependence on a condition selected from the group consisting of position and acceleration.

* * * * *